US007796053B2

(12) United States Patent
Bortolono et al.

(10) Patent No.: US 7,796,053 B2
(45) Date of Patent: Sep. 14, 2010

(54) TRAFFIC LIGHT WITH TIMER INFORMATION

(76) Inventors: Persio Walter Bortolono, c/o 70 Burnett Avenue, Winnipeg Manitoba (CA) R2G 1C1; Henry Kasdorf, 70 Burnett Avenue, Winnipeg Manitoba (CA) R2G 1C1

( * ) Notice: Subject to any disclaimer, the term of this patent is extended or adjusted under 35 U.S.C. 154(b) by 278 days.

(21) Appl. No.: 11/571,159

(22) PCT Filed: Jun. 27, 2005

(86) PCT No.: PCT/CA2005/001001

§ 371 (c)(1),
(2), (4) Date: Dec. 22, 2006

(87) PCT Pub. No.: WO2006/000097

PCT Pub. Date: Jan. 5, 2006

(65) Prior Publication Data

US 2007/0252727 A1 Nov. 1, 2007

(30) Foreign Application Priority Data

Jun. 25, 2004 (CA) ..... 2472514

(51) Int. Cl.
*G08G 1/096* (2006.01)

(52) U.S. Cl. ..... 340/929

(58) Field of Classification Search ..... 340/929
See application file for complete search history.

(56) References Cited

U.S. PATENT DOCUMENTS

| | | | | |
|---|---|---|---|---|
| 4,874,671 | A * | 10/1989 | Tahara et al. | 428/447 |
| 5,383,187 | A * | 1/1995 | Vardakas et al. | 370/312 |
| 6,502,965 | B1 * | 1/2003 | Bradford | 362/346 |
| 6,552,668 | B1 * | 4/2003 | Berezovsky | 340/929 |
| 6,833,796 | B2 * | 12/2004 | Bourgault | 340/929 |
| 7,443,315 | B2 * | 10/2008 | Lo | 340/907 |
| 2002/0005790 | A1 * | 1/2002 | Georgalis | 340/929 |

* cited by examiner

*Primary Examiner*—Davetta W Goins
*Assistant Examiner*—Ojiako Nwugo
(74) *Attorney, Agent, or Firm*—Michael R. Williams; Ade & Company Inc.

(57) ABSTRACT

An improved traffic light includes interval lights which are controlled by a control unit mounted to the light housing. The control unit allows the use of existing wiring and makes the light periods dynamic, that is, the traffic light periods can be responsive to changes in traffic flow as well as to the approach of emergency vehicles in real time.

8 Claims, 6 Drawing Sheets

TRAFFIC LIGHT WITH TIMER INFORMATION

PRIOR APPLICATION INFORMATION

This application claims the benefit of Canadian Patent Application 2,472,514, filed Jun. 25, 2004.

FIELD OF THE INVENTION

The present invention relates generally to the field of traffic lights and traffic control. More specifically, the present invention relates to a traffic light with time information.

SUMMARY OF THE INVENTION

According to a first aspect of the invention, there is provided a traffic light with time information comprising:

a control box having a stop light wire, a go light wire, a warning light wire and a common wire extending therefrom;

base lights arranged to indicate stop, go and warning when active;

a plurality of interval lights;

a control unit operably linked to the stop light wire, the go light wire, the warning light wire and the common wire and to the base lights and the interval lights such that said control unit activates an interval light when the stop base light or go base light is activated and activates subsequent interval lights in sequence while the corresponding base light is active.

DESCRIPTION OF THE PREFERRED EMBODIMENTS

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are now described. All publications mentioned hereunder are incorporated herein by reference.

As used herein, "stop light" and "red light" are used interchangeably, as are "green light" and "go light" and "yellow light" and "warning light" respectively. It is to be understood however that for example the stop light does not necessarily need to be red and may be any color in accordance with local customs.

Figure 3:
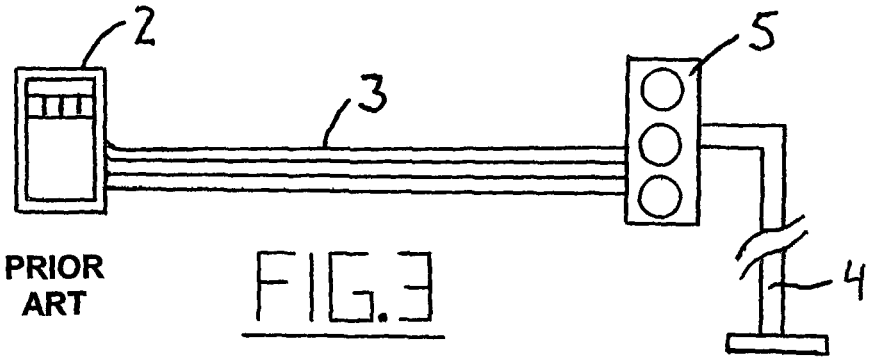
PRIOR ART FIG. 3
FIG. 3 is a schematic diagram showing the connections between a prior art control box and a prior art traffic light.

Referring to FIG. 3, a conventional or prior art traffic light comprises a control box 2, wiring 3, a light pole 4 and a light housing 5. As will be well known to one of skill in the art, the control box 2 is connected to the central station responsible for traffic lights. The wiring 3 from the control box extends up the light pole 4 and is connected to the traffic lights in the light housing 5.

Figure 4:
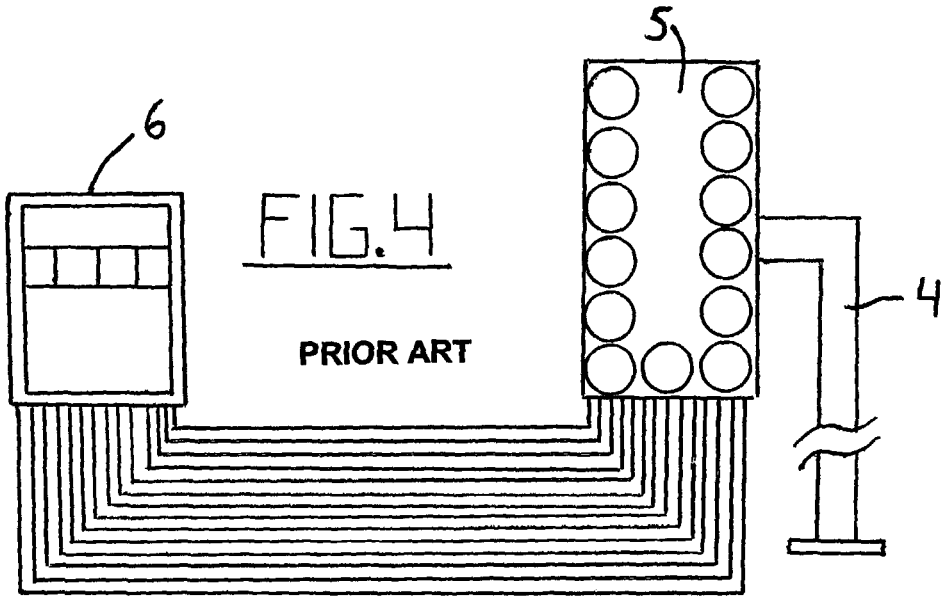
FIG. 4 PRIOR ART
FIG. 4 is a schematic diagram showing the connections between a prior art control box with time information and a prior art traffic light with time information.

Referring to FIG. 4, a prior art traffic light with time information comprises a control box 6, wiring 7, a light pole 4 and a light housing 5. As will be apparent and as discussed below, the control box 6 is larger than the conventional control box 2 and the number of wires extending therefrom is considerably more than with the conventional wiring 3.

Described herein are a number of arrangements for traffic lights having time information 1. As will be appreciated, several aspects of the system, for example, the specific positioning of the respective lights, the use of horizontal or vertical lighting arrangements, and having the interval lights 12 "move" upwards or downwards are to a large part a matter of choice and may be varied accordingly within the scope of the invention. However, the common inventive feature shared by the traffic lights having time information 1 described below is the use of a control unit 14 mounted either proximal to or within the light housing. Specifically, as discussed below, the control unit 14 is arranged to be operably linked to the standard four wires 3 of a conventional traffic light unit. The control unit 14 then runs a protocol based on information provided through the wires 3 which in turn activates the interval lights 12 in sequence according to a specific cadence, as discussed below. As will be appreciated by one of skill in the art, as used herein, one light cycle is the sum of the duration of the green light interval plus the yellow light interval plus the red light interval, that is, the duration of a complete light cycle. As used herein "cadence" refers to the time period during which a given interval light 12 is activated or at what intervals the interval lights 12 are activated, as discussed below. In most embodiments, multiplying the cadence by the number of interval lights 12 associated with a specific color in turn gives the duration of a given light period, that is, for example, the duration of a green light. In an alternative embodiment, when the light period or interval is long, the interval lights may only be activated towards the end of the light period. For example, if the green light period is greater than 20 seconds, the interval lights may only be activated towards the end of the green light period, for example, when 20 seconds remain. In this example, if there are 5 interval lights, each interval light would be active for 4 seconds, that is, the total time of activation of the interval lights is divided by the number of interval lights such that each interval light is active for approximately the same amount of time.

Thus, in some embodiments, the total time of the light period is divided by the number of interval lights such that each interval light is active for the same amount of time. For example, if the light period is 30 seconds and there are 6 interval lights, each interval light will be active for 5 seconds.

In an alternative embodiment, when the light period is long, the base light and the first interval light in sequence may be activated for a period of time after which the remaining interval lights are activated in sequence. For example, if the light period is 30 seconds and there are 6 interval lights, the first interval light and the base light may be held active for 10 seconds before the second interval light is activated. Interval lights 2 through 6 would then each be active for 4 seconds (4 seconds×5 lights=20 seconds total).

Figure 1:
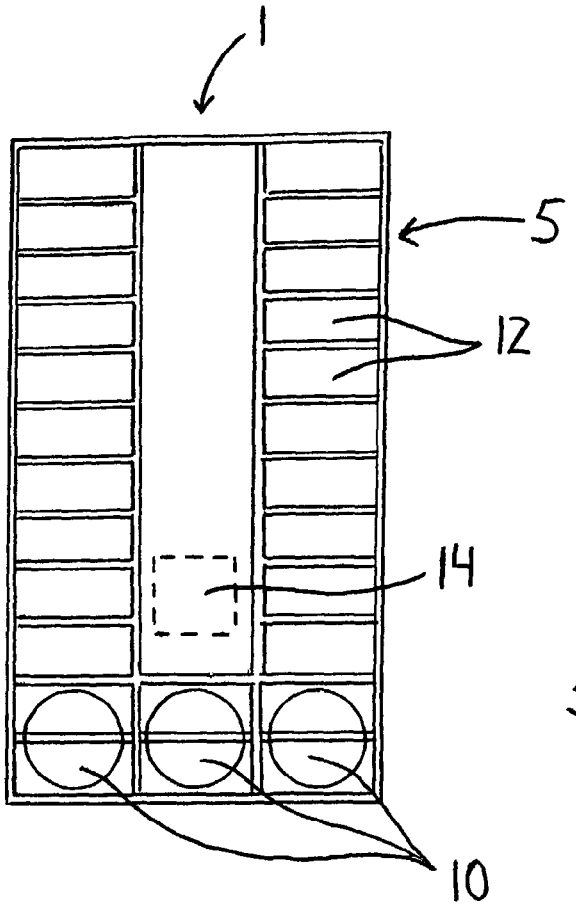
FIG. 1 is a front view of a traffic light with time information.

In the embodiment shown in FIG. 1, the light housing 5 of the traffic light with time information 1 includes 3 base lights 10 (red, yellow and green) located at the bottom of the light housing 5. Two columns of interval lights 12 extend upwardly from the red and green base lights 10 respectively. That is, the base lights 10 are arranged such that the red light is adjacent the yellow light and the yellow light is adjacent the green light and there are two separate columns of interval lights, each arranged to extend substantially upwards from the red base light and the green base light respectively.

As discussed herein, this is one possible arrangement for the traffic light with time information 1. In other embodiments, the base lights 10 may be at the top of the light housing 5 and the interval lights may be arranged in columns extending downward from the red and green base lights. Furthermore, in the embodiment shown in FIG. 1, there are 5 green interval lights 12 and 5 red interval lights 12. As will be appreciated by one of skill in the art, the exact number of interval lights 12 may be varied according to the preference of individual municipalities or civic governments. For example, the number of interval lights in a given series may be for example 2, 3, 4, 5, 6, 7, 8, 9 or 10 or any other suitable number, as discussed above.

The control unit 14 is also arranged to accept instructions to change the cadence or light cycle, for example, the duration of the cadence or light period or light cycle from a number of sources in addition to the central control center. As discussed below, these include but are by no means limited to emergency vehicles, such as fire trucks, police cars, ambulances and the like; transit vehicles; and wireless units held by traffic officials. As will be appreciated by one of skill in the art, as a result of this arrangement, the light cycles can be modified in real time while still providing ample warning to users.

The control unit 14 is also arranged to notify the central control center automatically when a light is burned out, as discussed below. Furthermore, in some embodiments, the control unit 14 is also arranged to respond to a query from a maintenance crew on the operating status of the traffic light with time information 1, as discussed below.

In some embodiments, the control unit 14 may also be connected to a message panel 20, as shown in FIGS. 6, 7, 8, 9, 10, 11 and 15 and as discussed below.

Described herein is an improved device and method for use with vehicular and/or pedestrian traffic lights, which provides the user, whether a driver or pedestrian with a clear reference for the time remaining in the signal light period. In preferred embodiments, the device is coupled to the wiring of a conventional traffic light but also informs the user of the time remaining before the light will change, that is, showing the user how long before green, for example, will change to yellow or red will change to green, as discussed below.

As will be appreciated by one of skill in the art, the addition of time interval information to the traffic light increases the interaction between the user and the traffic light, thereby providing the user drivers and pedestrians with sufficient and accurate information to enable them to decide if it is possible to cross the controlled intersection safely or not. This in turn reduces accidents and stress, and also reduces wear on vehicles'brakes and decreases the consumption of fuel in comparison with a conventional traffic light.

Previously, in order to incorporate a traffic light with time information 1 into an existing intersection having conventional traffic lights, it was necessary to substitute the control boxes and cables for those suited specifically for use with traffic lights with time information. As will be appreciated, this represented expensive electrical and civil work. As a result, many cities have resisted utilizing traffic lights with time information, on the basis that even the benefits of reducing accidents, stress and fuel consumption which these lights provide still did not justify the additional costs.

As discussed above, the control unit 14 having an intelligent circuit that through an embedded protocol allows the traffic light to start working in real time with the actual rate of progression of the timing light, that is, with the cadence of the interval light transition, as discussed below. Furthermore, as discussed below, in some embodiments, the control unit is part of the traffic light, that is, the control unit is either within the traffic light housing or is mounted proximal to the housing and operably linked to the interval lights and base lights, as discussed below. As will be appreciated by one of skill in the art, this arrangement diminishes the cost and eliminates the need for replacing control boxes and wiring. Rather, this arrangement enables the utilization of existing control boxes without the necessity of multiple specific cables having multiple routes, thereby increasing safety while reducing the risk of rupture or other disruptions from the use of too many cables.

As discussed herein, the control unit 14 is an integral part of the traffic light with time information 1. Specifically, the control unit 14 transforms static information, provided by the common traffic light control box 2 through the four wires 3, into dynamic information that, when connected, provides time information on traffic lights, as discussed below.

Contrast variations, or another form of color that makes them visible, informs the length of time of the color that is in course without having to use so many wires as one part to another.

In some embodiments, the control unit is connected to the yellow wire, the red wire, the green, and the common wire, already found extending from the control box of conventional traffic lights. Furthermore, the protocol within the control unit determines when the interval lights should start traveling down the panel, that is, the intelligent circuit determines at what interval and with what cadence the respective interval lights should be activated and inactivated, as discussed below. It is of note that in some embodiments, the protocol is arranged to accept instructions to either accelerate or de-accelerate the velocity of the cadence, that is, to either decrease or increase the intervals between respective interval lights, as discussed below. The instructions may be received from an external source, for example, from an emergency or police vehicle, from a traffic monitoring station or traffic light control station, or from a transit vehicle, or from an internal source, for example, protocols embedded in the control unit for different interval patterns based on the time of day.

This flexibility solves the serious problems that may occur when the changes to traffic signal duration can not be done in real time. That is, at various times of day, it may be desirable to alter the length of time of the green light at a specific crossing, according to the number of vehicles present at that specific time or due to unexpected changes in traffic flow.

For example, in the morning it is normal to have an increase in the quantity of vehicles heading from suburban areas to downtown; similarly, at lunch time, traffic flow may increase from downtown to suburban areas. After lunch, traffic flow towards downtown increases again.

Previously, the only way that it was possible to change interval time in a traffic light with time information was that of a "static circuit" placed between the prior art traffic controller and the traffic light with time information, store in a cycle the time of the color green of the executed period by the traffic controller, and in the next cycle execute the period of this time in the traffic light with information of time. That is, in many cases, manual intervention was required to change the period of a traffic light.

If, for example, a controller stays 30 seconds at a given period of green color of one approximation, the circuit will store this value and in the next cycle will execute this period in the semaphore. In the next cycle, the traffic controller may, because of the decrease of vehicle flow of that approximation, or because of a pre-programmed traffic plan, execute only 20 seconds in the period of the green color in that approximation and after that will remove the turned on condition of the green color and changes it to yellow or red. The "static circuit" at this time will still be executing the cadence of green colors, still missing half way to finish informing with security the time of the green color to the users pedestrians and drivers, when at this moment the condition of the turned on the green color has been removed by the controller, and transferred to yellow or red abruptly, occurring an interruption of the cadence, exposing the users in this case, the motorists, to a dangerous situation, since they are in a crossing position where if they try to stop they will provoke a traffic pile-up or rear-end collisions and if they try to pass through they will probably be exposed to the risk of lateral collisions. Equally if the cadence of the green color is interrupted in the middle of the crossing, it exposes the pedestrian to a situation of great risk, since he was counting on having enough time to cross with security and all of a sudden he is surprised by the fact that the semaphore is closed for him and opened for the vehicles. Another negative situation that is presented in this way of functioning and that gives rise to discredit of the traffic light with information of time is that if we utilize the already cited example, that in a cycle the traffic controller executes 30 seconds in the period of green color and the "static circuit" stores and prepares itself to execute the next cycle cadence, but the controller changes in this hour the time of the green color period to 40 seconds, in this situation it occurs that the "static circuit" executes all the cadence and stays in the last position of green color stopped for at least 10 seconds more then it should have, thereby discrediting the continuity, coherence and security that the traffic light was supposed to provide.

Presently, the only way of using traffic light with the information of time with 4 wires is using a "static circuit" and a traffic controller with fixed settings, where the controller executes the same cycle and duration regardless of any changes in traffic flow.

Currently, in order to have traffic lights with information of time respond to changes in traffic, it is necessary to have a wire for each type of information, that is, for each light, as shown in FIG. 4. For example, in U.S. Pat. No. 5,726,648, it is necessary to use a traffic controller that is very large and expensive, and that has multiple power switches and wires to interlink the controller to the traffic light. Specifically, this device needs 1 wire for common, 1 wire for red, 1 wire for yellow, 5 wires for the 5 colors that are below the yellow, and 14 wires to activate each segment of the 2 displays of 7 segments that are in the traffic light base, for a total of 22 wires. Similar arrangements are shown in for example U.S. Pat. No. 6,331,824, U.S. Pat. No. 5,838,260, Canadian Patent 2.17.780, all of which may be impractical to implement on a large scale.

The solution to the problems presented is the integration of the vehicular and pedestrian semaphores with time information with a control unit having an intelligent circuit which controls the division of time. This intelligent circuit acts through a protocol which allows the traffic lights to work in real time with the period of green color of the controller, and with a more efficacious cadence for that period. Because the intelligent circuit is an integral part of the traffic light, as shown in FIG. 1, this greatly decreases the cost of implementation by avoiding the substitution of wires, traffic controllers and control boxes.

As discussed below, the protocol allows real time functioning and synchronization of the traffic controller with the traffic light, and also uses the wires already in use in most pre-existing control boxes and wires.

In one embodiment, at the start of each light period, one of the wires, either yellow, red or green, receives a pulse for 1/10 of a second. In this moment the intelligent circuit starts an internal counting and waits for the second pulse; when this occurs, the circuit calculates the time interval between the first and second pulse and locates this interval on a decreasing table stored in the micro-controller of the equipment. This table in turn dictates the timing period to be used and the corresponding timing of the cadence is used.

For Example:

| If the interval between pulses is: | The cadence will be of: |
|---|---|
| 0.8 seconds | 6 seconds |
| 1.8 seconds | 9 seconds |
| 2.8 seconds | 12 seconds |
| 3.8 seconds | 15 seconds |
| 4.8 seconds | 17 seconds |
| 5.8 seconds | 18 seconds |
| 6.8 seconds | 19 seconds |
| 7.8 seconds | 20 seconds |

As will be appreciated by one of skill in the art, this is intended for illustrative purposes only and other suitable tables may also be used. Alternatively, in other embodiments, specific pulse durations may correspond to specific cadences or protocols, that is, for example, protocols which determine the cadence of all interval lights or the light period of each of the base lights, the duration of a light cycle and the like.

In some embodiments, once the timing cycle has started, if the intelligent circuit receives a pulse having a duration of ½ second on the yellow, red or green wire, it will increase the time of the cadence by, for example, 3 seconds. If the circuit receives multiple pulses of ½ second on the yellow, red or green wire, the circuit will add as many multiples of 3 seconds as the number of pulses received. That is, the duration of a specific light period can be increased or decreased while that light period is in progress by sending instructions to the circuit either through the wires or by wireless communication with the circuit.

Similarly, in some embodiments, if the circuit receives a pulse having a duration of 1/10 of a second in the yellow, red or green, the circuit will decrease the cadence by, for example, 3 seconds. Similarly, multiple pulses of 1/10 of a second will result in the cadence being shortened by 3 seconds for every pulse.

As discussed above, the duration of these increasing pulses and decreasing pulses are entirely arbitrary. That is, other pulse durations may be used to signal the control unit that the cadence of the timing cycle is to be modified. Similarly, a pulse of a given duration may be used to signal the control unit to restore the cadence to a default setting or begin flashing intermittently in addition to other suitable arrangements known to one of skill in the art.

Thus, in use, the control unit 14 of the traffic light with time information 1 receives a pulse of a given duration from the central control station via one of the 4 wires 3 or via other means as discussed herein. As discussed above, this establishes the protocol or cadence to be followed for the light period. As will be apparent to one of skill in the art, in some embodiments, the control unit 14 may continue to execute this protocol until instructions are given either from the central control station via the wires 3 or from a wireless unit as discussed above that the protocol is to be changed.

The light period for the green light begins with the green base light 10 and the top-most green interval light 12 being activated by the control unit 14. In some embodiments, once the interval time expires, the top-most interval light is turned off and the next interval light is activated. As discussed below, in other embodiments, there may be an overlap of a given time period wherein both interval lights are active, thereby providing even more accurate timing information to the user. This continues until the bottom-most interval light 12 completes its cadence, at which point the yellow light is activated. Once the yellow light completes its period, the light period for the red light begins with the red base light 10 and the top-most red interval light 12 being activated by the control unit 14. Once the cadence for a given interval light expires, that light is inactivated and the next interval light in sequence is activated. This continues until the bottom-most interval light is inactivated, at which point the green light period begins again.

It is important to note that while it is preferred that the cadence of respective interval lights within a red light period or green light period be constant, to increase the confidence of users that the information they are receiving is correct and consistent, it is not necessary that the cadence of red interval lights and green interval lights be identical. That is, the duration of a green light period may differ from the duration of a red light period for a given traffic light with time information. Furthermore, as discussed above, for example the approach of an emergency vehicle may result in the cadence of a given light period being shortened or increased temporarily.

As discussed above, it is important to note that during the light cycle, the control unit 14 is also confirming that the interval lights 12 and base lights 10 are functioning, as discussed herein.

FIG. 3 shows the electrical connections of a control box, connected by four wires to a prior art traffic light.

FIG. 4 shows the electrical connections of a prior art traffic light with time information connected by fourteen wires to a control box.

Comparing FIG. 3 with FIG. 4, we see that substituting the common traffic light with the prior art traffic light with time information required work to substitute the underground wiring with more wires, each having a greater diameter than the previous wires.

Figure 5:
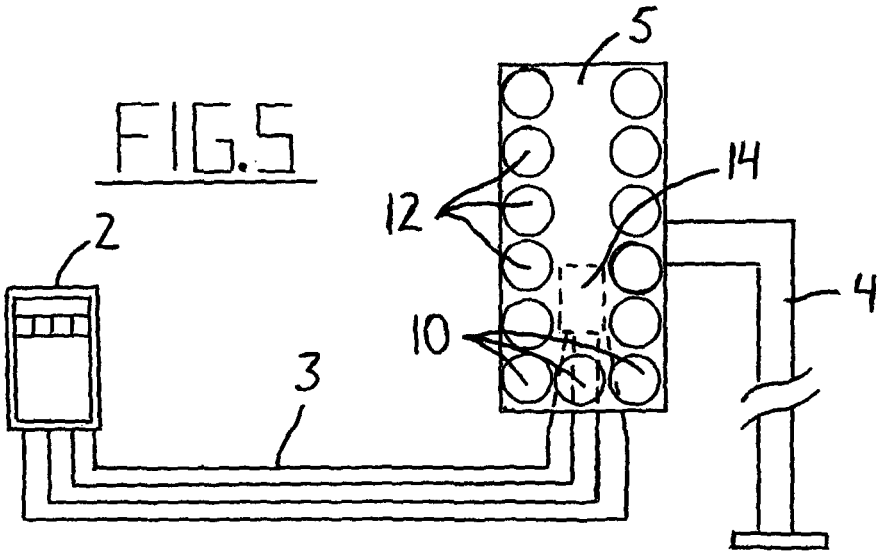
FIG. 5 is a schematic diagram showing the connections between a prior art control box and the traffic light with time information of the instant invention.

FIG. 5 shows a common traffic light control box connected by four wires to the control unit having an intelligent circuit 14 that is operably linked to the traffic light with time information. As can be seen, use of the intelligent circuit makes it possible to incorporate a traffic light with time information with great savings to the public, as it is not necessary to substitute the control box of the prior art traffic light for a new one, or substitute underground tubulations for new ones (which also requires re-building of asphalt and/or sidewalk), nor did it have to substitute one wiring system for a new one.

Another great advantage of the intelligent circuit is the increase in safety for users, both pedestrians and motorists, as the intelligent circuit also detects burnt out lights and adjust accordingly by adding time to the adjacent interval light, thereby eliminating the risk that a motorist or pedestrian will encounter a light suddenly turning red. As will be appreciated by one of skill in the art, this means fewer accidents which in turn will result in savings for the city or municipality in the form of fewer emergency calls and also fewer service calls by the crews responsible for the upkeep of the traffic light system.

As discussed above, the control unit is reliant upon existing wiring for instructions. Furthermore, the control unit is arranged to determine if different colors, that is, groupings of interval lights and/or base lights, are being activated simultaneously and to take appropriate steps if a conflict arises. In some embodiments, when a conflict arises, the control unit may inactivate the colors that allow movement (yellow and green) and activate the color that prevents movement (red) in all directions.

As discussed above, the control unit is arranged to determine if a given interval light is burned out and to adjust the time interval of an adjacent interval light accordingly. However, the control unit may also be arranged to notify the central station that one of the lights isn't working by transmitting a signal via the control box to the central station. In addition or alternatively, the control unit may be arranged to provide a signal either automatically or in response to an inquiry, for example, from a wireless device or similar signaling device in a repair truck. The signal may be for example blinking of one of the lights at the start of a timing cycle, although other suitable signals may be used and will be apparent to one skill in the art.

Figure 6:
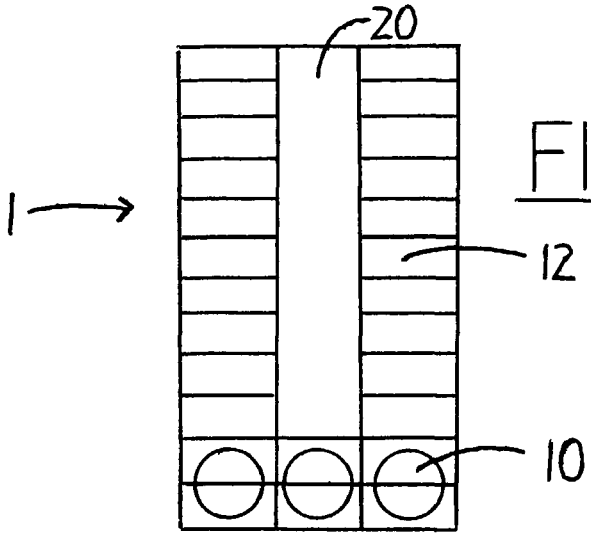
FIG. 6 shows a traffic light with time information having a message panel mounted thereon.
Figure 7:
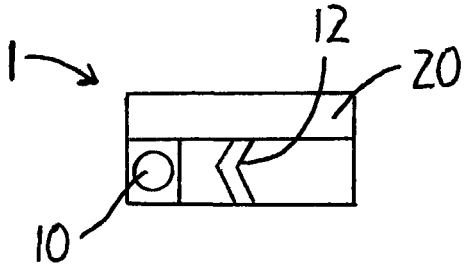
FIG. 7 shows an alternative arrangement for a traffic light with time information with a variable message panel mounted thereon.
Figure 8:
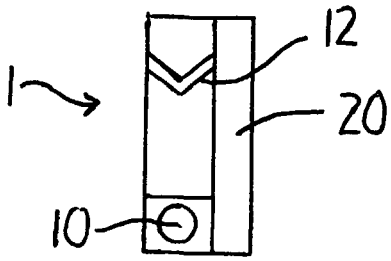
FIG. 8 shows an alternative arrangement for a traffic light with time information with a variable message panel mounted thereon.
Figure 9:
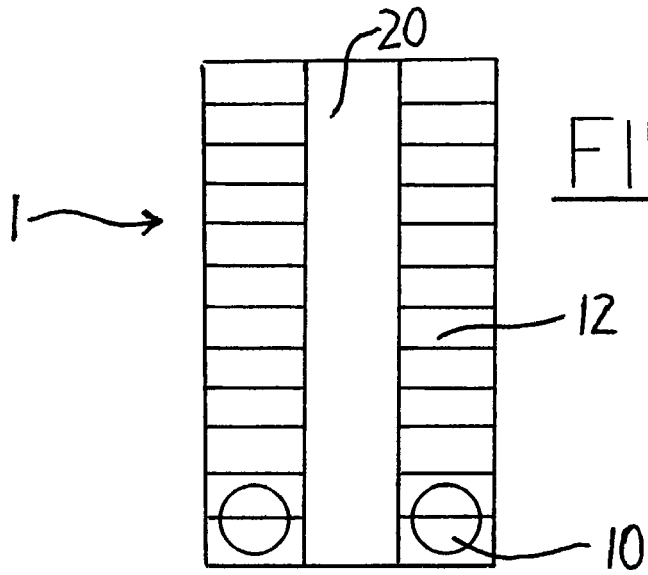
FIG. 9 is a front view of a pedestrian crossing light with time information.
Figure 10:
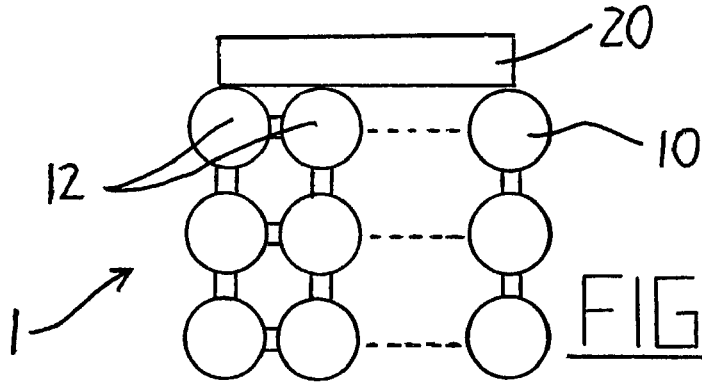
FIG. 10 is an alternative arrangement of the traffic light with time information including a variable message panel.
Figure 11:
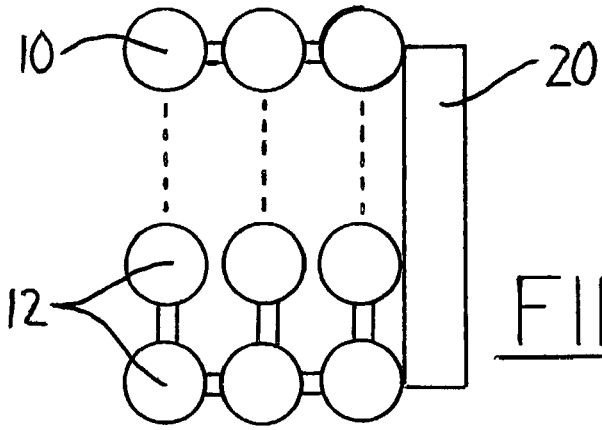
FIG. 11 is an alternative arrangement of the traffic light with time information including a variable message panel.

In some embodiments, the traffic lights may also include variable message panels 20 where important messages can be displayed at regular intervals. The message(s) may be transmitted to the control unit by wireless or radio waves. For example, the traffic department may use a console (handheld) to program specific messages which would be entered into memory and then displayed at programmed intervals. The panel can be placed as shown in FIGS. 6, 7, 8, 9, 10, 11, 12 and 15, although other suitable arrangements are within the scope of the invention. For example, as shown in FIG. 6, the panel may be a vertical panel situated between the columns of vertical interval lights. As shown in FIG. 7, the panel may be a horizontal panel positioned above the traffic light, wherein the traffic light also has a horizontal orientation. As shown in FIG. 8, the panel may be a vertical panel on either the left or right side of the traffic light. As shown in FIG. 9, the panel may be a vertical panel that extends along the entire length of the housing, with red and green interval lights and base lights being positioned on either side of the panel. As shown in FIG. 10, the panel may be a horizontal panel, the interval lights may be arranged in series to the left of the base light and the interval lights and the respective base lights may be approximately the same size. A similar embodiment is shown in FIG. 11 wherein the base lights are at the top of the traffic light display and the interval lights are positioned beneath the respective base lights in a column and the panel is to the right of the lights. In an embodiment shown in FIG. 12, the panel is positioned between the interval lights, similar to FIG. 6. In the embodiment shown in FIG. 15, the base lights are arranged vertically and the panel is a horizontal panel at the base of the light housing. The content of the messages may include information about traffic conditions, accidents, which alternative routes to take, which plate numbers can drive in that area on that day, the maximum speed allowed for that street, what speed the vehicle must maintain to drive in the "green lane", as well as other information that would contribute to the optimization of traffic routes.

In some embodiments, the control unit also includes an audible signal which can be activated by remote control for the visually or physically handicapped. In these embodiments, the control unit includes an audible signaling device which is activated by a wireless device, preferably one having a limited or short range. Once activated, the audible signal may convey the time remaining in the light cycle, for example, by producing an audible signal that increases or decreases in frequency or volume as the end of the cycle approaches. In some embodiments, in response to an activation signal, the control unit may respond with a short whistle or other similar audible signal indicating that the request has been received. In other embodiments, the control unit may emit an audible signal at the beginning of the light period, followed by a second signal when the period is almost over.

In other embodiments, the control unit may be responsive to a wireless signal from an emergency vehicle. In these embodiments, the approaching emergency vehicle notifies the control unit that it is approaching and that the light should remain green. Alternatively, if the light is red, the control unit may change the cadence of the light period, that is, shorten the time period that the interval light(s) are active and thereby the red light period so that the light can be changed to green as quickly as possible while still providing drivers with the opportunity to clear the intersection.

As discussed herein, the control unit with the intelligent circuit can be incorporated into a number of different designs of lights for providing timing information, such as, for example, traffic lights as shown in FIGS. 1, 6, 7, 8, 9, 10, 11 and 15, which are discussed above.

In some embodiments, the system is arranged so that when a given interval light is activated, the previous interval light remains active briefly as well so that there is an overlap between the two interval lights. As will be appreciated by one of skill in the art, as a result of this arrangement, the user, whether pedestrian or motorist, is provided with even more information on how much time remains in each interval prior to the light changing. In some embodiments, the first light may remain active for the initial 20% of the time period for the next light. When the bottom-most timing light has completed its interval, the yellow light is activated and the bottom-most light is disabled. This provides the user with information on how long they have to clear the intersection. As will be appreciated by one of skill in the art, other suitable overlap intervals may be used at the discretion of the traffic authority, for example, 10%, 15%, 25%, 30%, 33%, 35%, and the like. This in turn results in greater traffic light effectiveness with the largest interaction between users and the traffic light with time information, because during the period where two interval lights are simultaneously activated, the visibility of the traffic light is increased and the information provided is dynamic. This in turn allows the users to make decisions with greater precision, that is, deciding whether to proceed, to slow down or to prepare to stop, which in turn greatly reduces the stress of the users. Given the concerns regarding "road rage", this is clearly not a small advantage.

Figure 12:
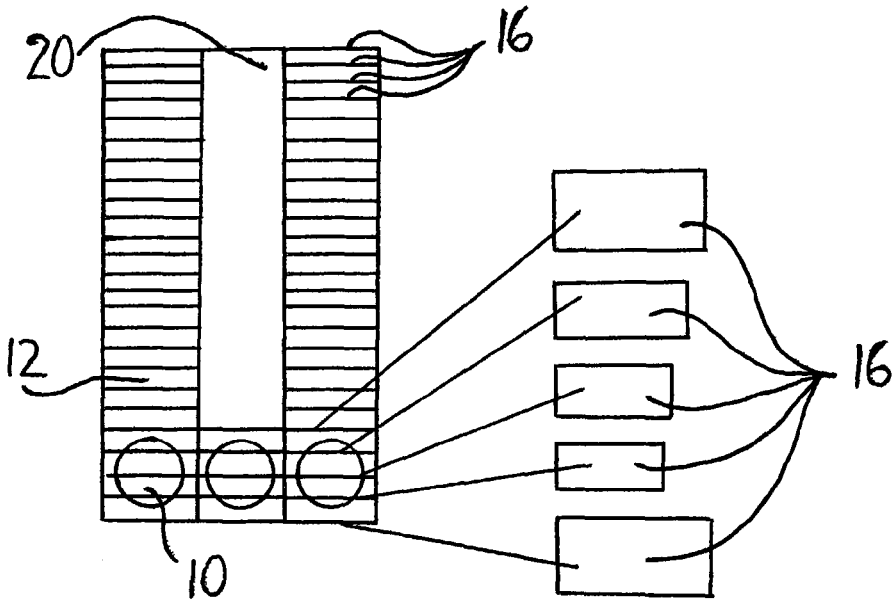
FIG. 12 is a front view of the traffic light with time information of FIG. 1 including anti-glare panels which shows that the panels are of different lengths.
Figure 14:
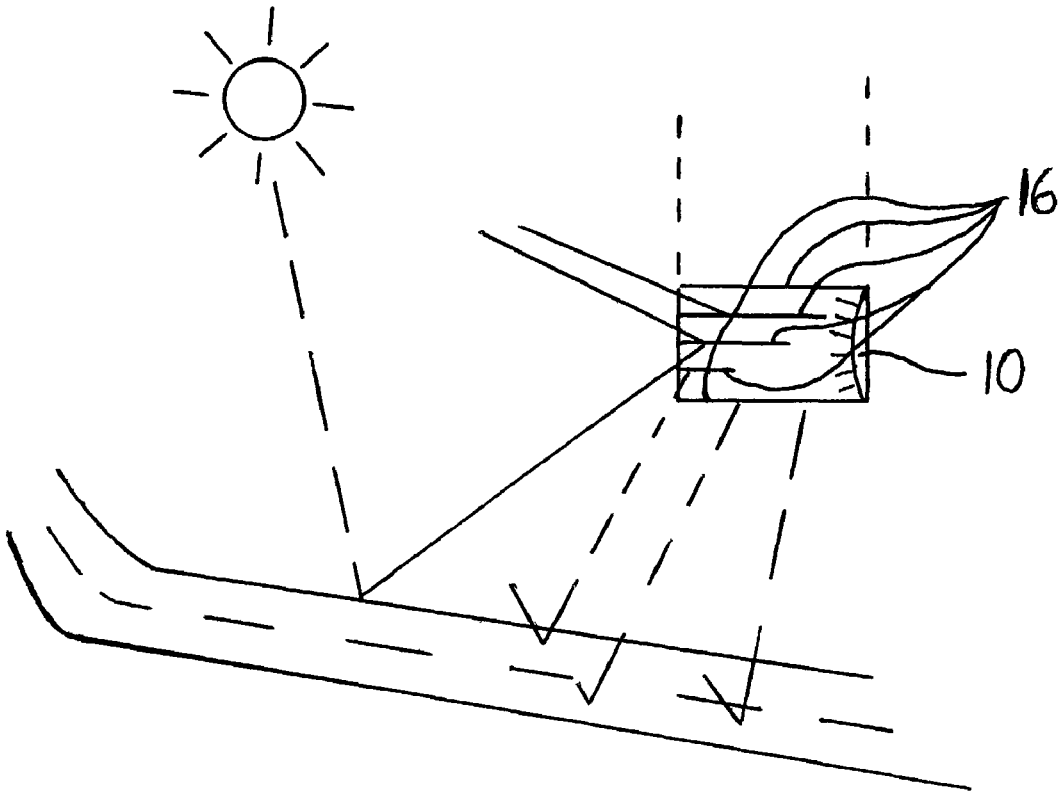
FIG. 14 shows how the panels of varying length block reflected glare.

In some embodiments, the lateral and central compartments shown in FIG. 1 will have mounted thereon glare protectors 16 which provide better visibility on sunny days. In one embodiment, the glare protectors are composed of thirteen multiple folded panels which in turn form multiple compartments as shown in FIG. 1. In another embodiment, the glare protectors 16 are composed of 25 double panels, as shown in FIG. 12. Specifically, as can be seen in FIG. 14, the panels decrease in length on a progressive scale, thereby forming multiple compartments, as shown in FIG. 12. For example, there may be a compartment for each interval light as well as each base light and for the message panel if one is included on the traffic light design. These compartments improve the visibility of the lights and the panel by reducing glare, as illustrated in FIG. 14 which shows two full-length glare panels extending from the top or bottom of the light, for example, a base light, to the front face of the light housing, thereby forming the compartment and a plurality of shorter glare panels extending from the front of the light housing to different positions in front of the light. This arrangement is particularly suited for open locations, specifically those with high solar reflection, for example, from snow and ice, and provide better visual observation of the traffic lights on a sunny day. As will be apparent to one of skill in the art, these panels may be used in combination with any of the traffic lights described herein, for example, those shown in FIGS. 1, 6, 7, 8, 9, 10, 11 and 15.

In these embodiments, wherein the traffic lights utilize multiple folded panels as the glare protectors 16, the panels may actually become effectively shelves for ice and snow to accumulate, thus obstructing viewing of the lights and also potentially causing the lights to fall to the ground due to excessive weight.

Figure 13:
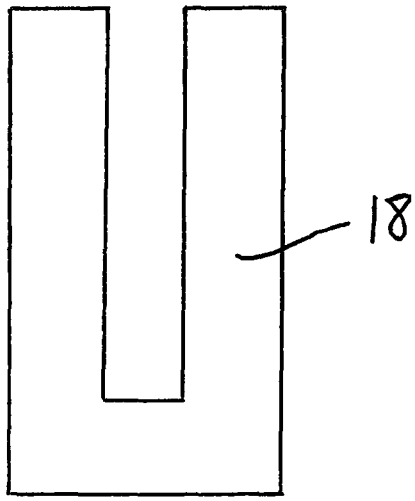
FIG. 13 is a front view of the translucent cover for the traffic light with time information shown in FIG. 1.

The solution is the incorporation in the front of the compartments of a translucent sheet, shown in FIG. 13, which thereby prevents accumulation of snow and ice in the internal divisions of the light visors.

Figure 2:
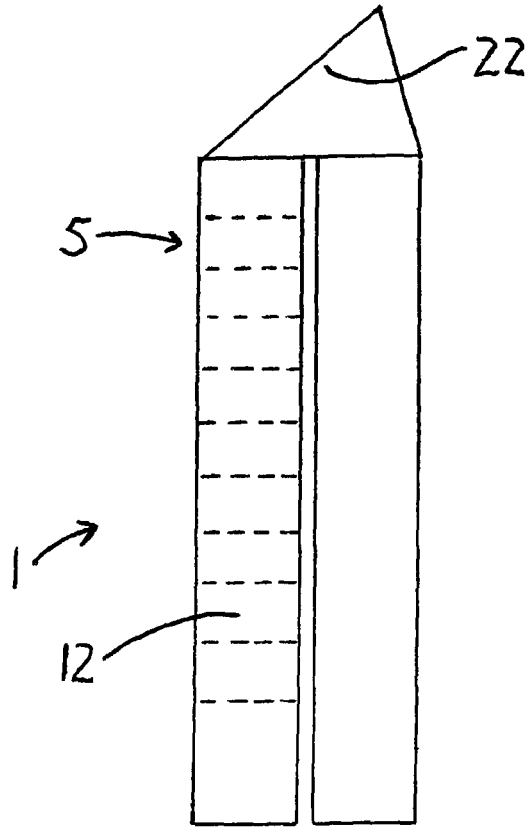
FIG. 2 is a side view of a traffic light with time information.

It is of note that ice and snow may also accumulate on top of the traffic light. The solution for the presented problem is shown in FIG. 2, which involves the placing of a slanted plate 22 on top of the lights, Which prevents the accumulation of snow and ice on top of the light housing 5. As will be appreciated by one of skill in the art, the panels as described above may be incorporated on any of the lights described herein, for example, as shown in FIGS. 1, 6, 7, 8, 9, 10, 11 and 15.

It is of note that the color of the individual lights as well as the color of lights used in the message panel discussed above may be varied according to custom or desire and these alternative colors are within the scope of the invention. Alternatively, the lights used may be white or other appropriate color and appropriate filters may be used to produce the desired color. Furthermore, the light source for the lights and/or message panels may be any suitable light source known in the art, for example, incandescent bulbs, LEDs, liquid crystal panels, neon and the like. As will be appreciated by one of skill in the art, it is preferred that the lights be visible under a variety of conditions, including both day and night.

Shown in FIG. 9 is a pedestrian traffic light which is similar in form to that shown in FIG. 1, the exception being that the yellow color is not set up and the size of the pedestrian traffic light is more appropriate for its intended use. In the embodiment shown in FIG. 9, the pedestrian traffic light includes a variable message panel 20, although other embodiments may not include this feature.

FIGS. 7 and 8 show an alternative embodiment of the traffic light with time information wherein the traffic light with time information that requires the same amount of space as used by conventional traffic lights. As will be appreciated by one of skill in the art, this arrangement allows the placing of only one color at a time. However, because of advances in suitable materials, it is possible to arrange to have the base lights in the same approximate positions as in the tradition traffic lights which are activated in turn. Furthermore, when the yellow and red or green and yellow lights are inactive, this space is used to convey time information, for example, a series of interval lights which travel either away from or towards the active base light. As shown in FIGS. 7 and 8, these lights may be arranged horizontally or vertically. Furthermore, the interval lights may have any suitable shape or color and in some embodiments may correspond in color to the respective base light. It is of note that in the embodiments shown in FIGS. 7 and 8, these traffic lights with time information also include variable message panels 20 although in other embodiments, this feature may be omitted.

FIGS. 10 and 11 show an alternative embodiment of the invention wherein the interval lights correspond substantially in size and shape to the individual modules of traditional traffic lights. In this concept, as many individual modules per color as necessary, in a preferred embodiment, six, are activated and inactivated in accordance with the cadence designated by the control unit as discussed above. Furthermore, in the embodiment shown in FIG. 11, the base lights 10 are at the top of the traffic light with time information 1 although in other embodiments wherein the lights are arranged horizontally, the base lights 10 may be at the bottom of the traffic light with time information 1. Similarly, in the embodiment shown in FIG. 10, the base lights 10 are at the right-most position but in other embodiments, the base lights 10 may be the left-most lights.

Figure 15:
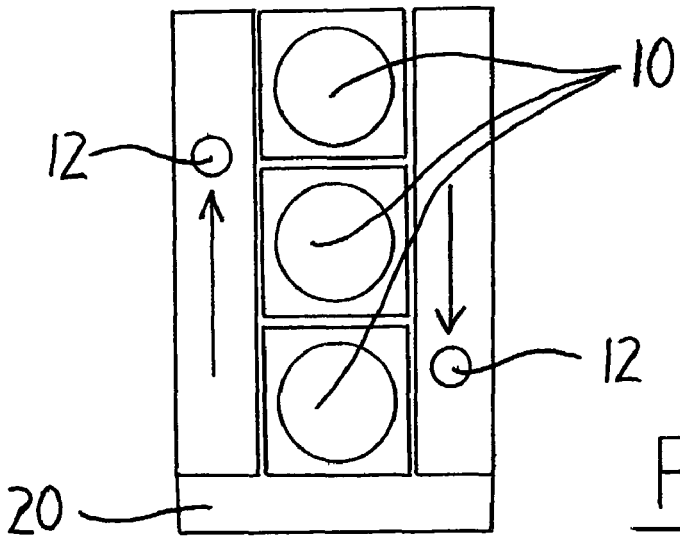
FIG. 15 is an alternative arrangement of the traffic light with time information of the instant invention.

In an embodiment shown in FIG. 15, the traffic light with time information comprises base lights arranged substantially as with a conventional vertical traffic light, specifically, with the red light at the top, the yellow light in the middle and a green light at the bottom. On each side of the light housing is a display for providing time information relating to the time remaining in the light period. In some embodiments, the display may comprise a number of interval lights as discussed above.

It is of note that as discussed above, the general shape of the light housing, shown generally as 5 throughout the figures, may be varied considerably for use with the traffic light with time information 1, various examples of which are shown in FIGS. 1, 2, 5, 6, 7, 8, 9, 10, 11, 12 and 15. As discussed above, the interval lights may also be of a variety of sizes and shapes, and may comprise a series of individual lights having a distinct shape and/or color. In other embodiments, the interval lights may be represented by for example but by no means limited to symbols either having discrete positions on a display screen or appearing to travel along in a display screen in a smooth motion.

While the preferred embodiments of the invention have been described above, it will be recognized and understood that various modifications may be made therein, and the appended claims are intended to cover all such modifications which may fall within the spirit and scope of the invention.

The invention claimed is:

1. A traffic light with time information comprising:

a control box having a stop light wire, a go light wire, a warning light wire and a common wire extending therefrom;

base lights arranged to indicate stop with a red base light, go with a green base light and warning with a yellow base light when active;

a plurality of interval lights arranged in two separate columns, one column extending from the red base light and one column extending from the green base light;

a control unit operably linked to the stop light wire, the go light wire, the warning light wire and the common wire and to the base lights and the interval lights such that said control unit activates an interval light when the stop base light or go base light is activated and activates subsequent interval lights in the respective column in sequence while the corresponding base light is active, said interval lights being activated according to a specific cadence such that each interval light is active for approximately the same amount of time, said control unit comprising an intelligent circuit having a protocol which determines the cadence of the interval lights, said protocol being arranged to accept instructions to either accelerate or de-accelerate the cadence.

2. The traffic light with time information according to claim 1 including a message panel connected to the control unit for displaying text messages.

3. The traffic light with time information according to claim 1 including a plurality of glare reflectors positioned in front of the base lights and the interval lights.

4. The traffic light with time information according to claim 3 including a translucent cover mounted in front of the glare reflectors.

5. The traffic light with time information according to claim 1 including a slanted plate on top of the lights, which prevents the accumulation of snow and ice on top of the light housing.

6. The traffic light with time information according to claim 1 wherein there are 5 green interval lights and 5 red interval lights.

7. The traffic light with time information according to claim 1 wherein the instructions can be received from an external source.

8. The traffic light with time information according to claim 1 wherein one interval light is turned off before the next interval light is activated.

* * * * *